US012448886B2

(12) United States Patent
Fischer et al.

(10) Patent No.: US 12,448,886 B2
(45) Date of Patent: Oct. 21, 2025

(54) METHOD AND SYSTEM FOR DETERMINING A SOIL CLASS AND USE DURING DETERMINATION OF A SOIL CLASS

(71) Applicant: TRACTO-TECHNIK GMBH & CO. KG, Lennestadt (DE)

(72) Inventors: Sebastian Fischer, Lennestadt (DE); Markus Hamers, Lennestadt (DE)

(73) Assignee: TRACTO-TECHNIK GMBH & CO. KG, Lennestadt (DE)

( * ) Notice: Subject to any disclaimer, the term of this patent is extended or adjusted under 35 U.S.C. 154(b) by 0 days.

(21) Appl. No.: 16/467,325

(22) PCT Filed: Dec. 6, 2017

(86) PCT No.: PCT/EP2017/081662
§ 371 (c)(1),
(2) Date: Jun. 6, 2019

(87) PCT Pub. No.: WO2018/108662
PCT Pub. Date: Jun. 21, 2018

(65) Prior Publication Data

US 2020/0072046 A1 Mar. 5, 2020

(30) Foreign Application Priority Data

Dec. 12, 2016 (DE) ..... 102016014685.0

(51) Int. Cl.
*E21B 7/04* (2006.01)
*E02D 1/02* (2006.01)
*E21B 49/00* (2006.01)

(52) U.S. Cl.
CPC ..... *E21B 49/003* (2013.01); *E02D 1/022* (2013.01); *E21B 7/046* (2013.01)

(58) Field of Classification Search
CPC ..... E21B 44/00; E21B 49/003; E21B 49/005; E02D 1/022; E02D 1/027
See application file for complete search history.

(56) References Cited

U.S. PATENT DOCUMENTS 2,640,351 A * 6/1953 Jourdain ..... E02D 1/022 73/84
2,671,346 A * 3/1954 Banning, Jr. ..... E21B 47/04 73/152.44

(Continued)

FOREIGN PATENT DOCUMENTS

DE 3328751 A1 2/1984
DE 19707530 A1 9/1998

(Continued)

OTHER PUBLICATIONS

General Technical Terms and Conditions for Construction Contracts, Horizontal flushing drilling operations, Horizontal directional drilling works, Horizontal Drilling Directs; DIN 18324; German Institute for Standardization; Standards Committee for Civil Engineering; Sep. 2016.

*Primary Examiner* — Giovanna Wright
(74) *Attorney, Agent, or Firm* — Howard IP Law Group

(57) ABSTRACT

The invention relates to methods for determining a soil class, in which an earth borehole is introduced into the ground by means of a ground drilling device with a drill head, wherein a parameter of the ground drilling device and/or an operational parameter of the ground drilling device is assessed during the determination of which soil class is involved.

8 Claims, 1 Drawing Sheet

(56) References Cited

U.S. PATENT DOCUMENTS 2,957,341 A * 10/1960 Menard ..... E02D 1/022 73/84
3,175,392 A * 3/1965 Tharalson ..... E02D 1/025 73/84
3,372,386 A 3/1968 Klinger et al.
3,481,188 A * 12/1969 Mori ..... E21B 49/006 73/84
3,500,678 A * 3/1970 Van Romondt Vis .. E21B 7/124 73/84
3,906,781 A * 9/1975 Vlasblom ..... E02D 1/027 73/84
3,988,923 A * 11/1976 Elmiger ..... E02D 1/022 73/84
4,553,226 A * 11/1985 Scherbatskoy ..... E21B 47/185 175/40
4,628,295 A 12/1986 Yasuda et al.
4,628,495 A 12/1986 Peppers et al.
4,804,051 A * 2/1989 Ho ..... E21B 44/00 175/45
5,127,270 A * 7/1992 Yabuuchi ..... E02D 1/02 73/784
5,581,013 A * 12/1996 Frederick ..... G01L 5/0052 73/11.03
5,813,480 A 9/1998 Zaleski, Jr. et al.
6,062,090 A * 5/2000 Bachhuber ..... E02D 1/022 73/784
6,400,646 B1 * 6/2002 Shah ..... E21B 47/16 367/82
10,316,482 B2 * 6/2019 Hoekstra ..... G01N 33/24
2003/0226663 A1 12/2003 Krueger et al.
2004/0040746 A1 * 3/2004 Niedermayr ..... E21B 44/00 175/48
2006/0212224 A1 9/2006 Jogi et al.
2007/0144781 A1 * 6/2007 Hinshaw ..... E21D 20/003 175/40
2009/0152005 A1 * 6/2009 Chapman ..... E21B 44/00 702/9
2012/0255781 A1 10/2012 Blange
2013/0000980 A1 1/2013 Dolgin et al.
2013/0075157 A1 * 3/2013 Yang ..... E21B 47/095 175/40
2013/0278432 A1 * 10/2013 Shashoua ..... G01V 11/002 340/853.7
2016/0069182 A1 3/2016 Neale et al.

FOREIGN PATENT DOCUMENTS

DE 19808478 A1 9/1999
DE 10116363 A1 10/2002
DE 69635694 T2 9/2006
DE 60320101 T2 5/2009
EP 1942247 A1 7/2008
WO WO-9715749 A2 * 5/1997 ..... E21B 44/00
WO WO-02084065 A2 * 10/2002 ..... E21B 47/00

* cited by examiner

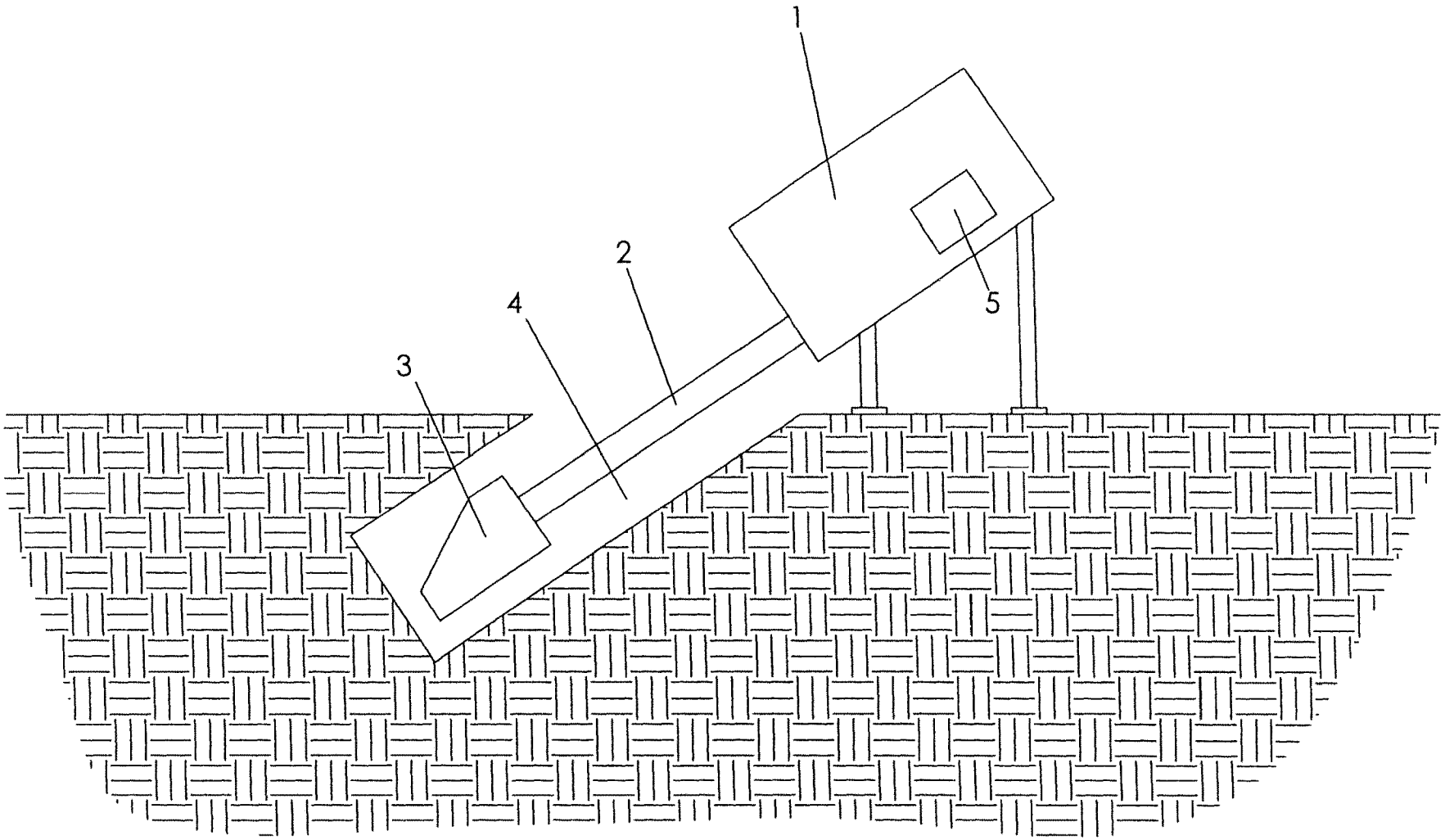
1
2
3
4
5

METHOD AND SYSTEM FOR DETERMINING A SOIL CLASS AND USE DURING DETERMINATION OF A SOIL CLASS

CROSS-REFERENCE TO RELATED APPLICATIONS

This application is the national stage application under 35 U.S.C. § 371 of International Application No. PCT/EP2017/081662 filed on 6 Dec. 2017, and claims the benefit of DE 10 2016 014 685.0 filed on 12 Dec. 2016, the entire disclosures of which are incorporated herein by reference in their entireties.

The invention relates to a method and a system for determining a soil class as well as the use thereof when determining a soil class.

During construction processes one needs to make determinations about the underlying ground for the planned construction. This may be described in terms of the nature, position, and condition of soil, rock, and ground water. The determinations about the underlying ground may help avoid failed investment and prevent structural damage. The forces acting on the underlying ground from the construction measure or project go into assessing whether the nature, position, and condition of soil, rock, and ground water will withstand the planned design of the construction measure or whether steps need to be taken to secure the construction measure.

As a rule, the exploring of the underlying ground is done by experts in geotechnology or engineering geology, in which process samples are taken and analyzed. Such investigations and determinations are the province of persons with appropriate qualifications and they are costly.

The problem which the invention proposes to solve is to determine a soil class more easily.

The problem is solved by the subject matter of the coordinated patent claims. Advantageous modifications are the subject matter of the dependent patent claims and they will emerge from the following specification.

The key notion of the invention is to determine a soil class for an earth borehole being produced, especially also an earth borehole which is being produced not primarily for the determination of the soil class, but rather for the pulling in of pipes and/or the replacing of conduits or pipes. In this regard, it is not the taking of samples with a subsequent analysis thereof which stands in the forefront, but rather the parameters with which the earth borehole is created will be evaluated to determine the soil class. The parameters of the ground drilling device itself can be used for the determining of the soil class. For the first time, the invention has recognized that a classification of the soil or the underlying ground is possible on the basis of drilling data of the machine when creating a borehole in the soil. The soil class can be determined from the knowledge of how the borehole was produced in the soil and/or which drilling tools were used.

The invention creates a method for determining a soil class in which an earth borehole is being made in the soil by means of a ground drilling device with a drilling head. A parameter of the ground drilling device and/or an operating parameter of the ground drilling device is evaluated to determine which soil class is present.

The term "soil class" in the sense of the invention concerns a classification or subdivision of soil types, especially for construction engineering purposes. Different classifications are possible, whereby for example a classification is possible in terms of grain size and grain size distribution, water content, plasticity and consistency, organic substance, strength, hardness and workability and/or solubility. In particular, a soil class may be a subdivision in which an overlapping classification of the soil is also possible, namely, in two neighboring classes. In particular, a soil class may be a subdivision in terms of solubility and earthwork properties; a subdivision of the soil class can be done in particular on the basis of 18300 VOB/C "Earthworks" or ÜNORM B2205 "Earthworks/Standard contract for work", especially on the basis of DIN 18324 (VOB Tendering and contracting rules for construction projects—Part C: General technical contract terms for construction work (ATV)—Horizontal mud-flush drilling).

The term "ground drilling device" in the sense of the invention encompasses any device with which a "ground drilling" can be performed. A ground drilling device can be any device which moves a drill string, especially one having short lengths of drill rods with a drilling head, in an existing channel in the earth or one being created in order to produce and/or widen an earth borehole, especially a horizontal drilling (HD), or to pull pipelines or other long objects into the earth. The ground drilling device may be in particular a HD device. A ground drilling device comprises a device advancing a drill string, working by displacing earth, and the drill string is introduced by rotation and/or translation in the longitudinally axial direction of the drill string into the earth.

The term "HD" (horizontal drilling) in the sense of the present invention encompasses in particular every type of existing or yet to be created channels, preferably horizontal channels in a body, especially earth channels, including earth boreholes, rock boreholes, or earth conduits, as well as underground or aboveground pipelines and water canals which can be produced or laid by the use of a corresponding ground drilling device.

The term "drilling head" in the sense of the invention describes a drilling tool attached to the end of a drill string, which is introduced into the earth borehole in front of the drill string and connected to it. The drilling head may have exits for drilling mud, and the drilling mud may be used to soften the soil lying in front of the drilling head of the ground drilling device and thereby improve the cutting action of the drilling head. The drilling mud may be a mixture of water and a mineral, especially bentonite, and possibly certain additives, which may also be minerals.

In one preferred embodiment, the parameter of the ground drilling device is chosen to be the type of the drilling head and/or the power of the ground drilling device. In this way, the first parameter may be considered in the form of the material used for producing the earth borehole, in particular the kind of drilling tool, which comes down to the type of drilling head. The type of drilling head may be a soft, medium, hard drill head, roller bit, fishtail bit, diamond bit, PDC bit, hybrid bit, eccentric roller bit, big hole roller bit, wing bit or percussion drill bit. By taking into account the type of drilling tool, especially the type of drilling head, one can generate complex information making possible the classification of the soil. For example, in easily soluble rock it is possible to introduce into the soil a drilling head which is "overdimensioned" for this, unlike a drilling head specially adapted for easily soluble rock.

In one preferred embodiment, the operating parameter of the ground drilling device is chosen to be the torque, the tensile/compressive force, the speed of advancement, the mud-flush rate and/or the rotational speed. In this way, a classification or determination of the soil class can be done from the current drilling data, such as the settings chosen on the ground drilling device in order to produce the current earth borehole. A complex consideration of some or all of the operating parameters together with the parameters of the ground drilling device is possible.

In one preferred embodiment, a signal of a sensor on the drilling head is also used, wherein the signal in particular can be correlated with a pressure in the earth borehole and/or a soil quality. In this way, the pressure in the earth borehole and/or the soil quality can also be taken into account. All types of pressure sensors as absolute or differential pressure sensors with different physical principles are possible. Examples of these are piezo-resistive, piezoelectrical, capacitive and inductive pressure sensors as well as pressure sensors with a Hall element, etc. Examples of sensors for the soil quality which can be mentioned are: seismic sensors, sound pressure sensors for measurement of ground-dependent structure-borne sound, scratch sensors or acoustical geo-scanners.

In one preferred embodiment, the location of the drilling head is determined and a correlation between the soil class determined and the location is produced. In this way, a geographical correlation of the soil class can be produced, with which recommendations for the construction machinery can be made at a later time.

In one preferred embodiment, a database is created to provide a correlation between location and soil class, so that in the supplement of a construction site database can be queried appropriate measures selected. A correlation with commercially available or free map material (such as Google Earth) is possible.

The invention also creates a system for determining a soil class, wherein the system comprises a ground drilling device having a drilling head. The system uses parameters and/or operating parameters of the ground drilling device to determine the soil class of the soil. Remarks regarding the method for determining a soil class in the specification and the claims as well as the FIGURE apply accordingly to the system.

The system may comprise in particular a programmed control system or logic-based control system working off commands, with which the parameters and/or operating parameters of the ground drilling device can be detected in order to determine the soil class of the soil. For example, it is possible for the user to enter the type of drilling tool, or for the drilling head to be recognized by the system, for example by means of a sensor. The operating parameters of the ground drilling device in the form of the machine data, such as torque, tensile/compressive force, speed of advancement, mud-flush rate and/or rotational speed can be read out from the ground drilling device when creating the earth borehole. A database may contain the different operating parameters of the ground drilling device and/or the parameters of the ground drilling device and assign a soil class to a combination present in the database. A tuple comprising the operating parameters of the ground drilling device and/or the parameters of the ground drilling device may be assigned to a soil class. The evaluated or determined soil class may in a preferred embodiment exert influence on the machine control of the ground drilling device, for example in order to optimize the process of creating the earth borehole. It is also possible to use a fuzzy logic to determine the soil class from the operating parameters of the ground drilling device and/or the parameters of the ground drilling device.

In one preferred embodiment, a sensor is arranged on the drilling head and the signal of the sensor is used to determine the soil class. The sensor may be designed to determine the pressure in the earth borehole. The sensor arranged on the drilling head may also be a sensor for detecting the soil quality.

In one preferred embodiment, the system comprises a locating unit with which the location of the drilling head is determinable, wherein the unit links up a data point correlated with the location of the drilling head to the soil class determined.

The invention also creates a use during the determining of a soil class, wherein an earth borehole is produced in the soil, and at least one parameter and/or at least one operating parameter of the ground drilling device is used to determine the soil class. Remarks regarding the method and system for determining a soil class apply analogously to the use.

The preceding remarks, just as the following description of exemplary embodiments, do not constitute any abandonment of particular embodiments or features.

The invention shall now be explained more closely with the aid of exemplary embodiments presented in the drawing.

The single FIGURE shows in a schematic, partly sectioned representation, a ground drilling device 1 with a drill string 2 and a drilling head 3 fastened at the front end to the drill string 2. By means of the ground drilling device 1, an earth borehole 4 is produced in the soil. A program 5, which runs in the hardware of the ground drilling device 1, detects the parameters of the ground drilling device 1 and the operating parameters of the ground drilling device 1. The program 5 can carry out a classification of the soil as Ground Class "six" for example, if a high torque, a high compressive force, and a small rate of advancement have been established for the operating parameters of the ground drilling device 1 and a roller bit is used for the parameter of the ground drilling device 1.

The invention claimed is:

1. A method for determining one or more soil classes in a given area of interest without performing a geological sample analysis on said area, the method comprising:

drilling an earth borehole in said given area by means of a horizontal ground drilling device using a drilling head of a given type selected from one or more different types;

setting operating parameters of the horizontal ground drilling device for operation of the horizontal ground drilling device for drilling at least a portion of the earth borehole with the selected drilling head, the operating parameters comprising the torque, tensile/compressive force, speed of advancement, mud-flush rate and rotational speed;

during said drilling of said borehole in said area of interest, determining by a programmed control system of the horizontal ground drilling device, a given soil class present in the portion of the earth borehole being drilled, based on the drilling head type used, and said operating parameters, in association with a database of soil classifications which associates soil classes with drilling head type, and the operating parameters, said given soil class comprising at least one of a grain size soil class, a grain size distribution soil class, a water content soil class, a plasticity and consistency soil class, an organic substance soil class, a hardness soil class, and a solubility soil class present in the portion of the earth borehole being drilled;

wherein the programmed control system exerts influence on the horizontal ground drilling device's machine control to optimize the process of creating the horizontal earth borehole;

determining location points of the drilling head during said drilling operation, and correlating said received location points of the drilling head with the determined soil class, to thereby map the determined one or more soil classes over the select area of interest, wherein said determining said given soil class present is performed upon sensing a change in one or more of the type of drilling head being used and said at least one set operating parameter.

2. The method according to claim 1, further comprising, during said drilling operation, determining, via a sensor positioned on the drilling head, a pressure in the earth borehole, and determining a soil class at a location in said borehole using said determined pressure.

3. The method according to claim 1, further comprising generating a database correlating determined drill head location and determined soil class.

4. The method according to claim 1, wherein the programmed control system uses fuzzy logic to determine the soil class from the operating parameters of the horizontal ground drilling device and the selected drilling head.

5. A horizontal ground drilling device comprising:

a drill string;

a drilling head fastened at the front end to the drill string;

a programmed control system executable in said horizontal ground drilling device, the programmed control system programmed to detect and evaluate:

a type of the drilling head selected for drilling at least a portion of the earth borehole over a select area of interest; and operating parameters of the horizontal ground drilling device, comprising a setting chosen for operation of the horizontal ground drilling device for drilling the portion of the earth borehole with the selected drilling head, the operating parameters of the horizontal ground drilling device comprising the torque, the tensile/compressive force, the speed of advancement, the mud-flush rate and the rotational speed of the horizontal ground drilling device;

wherein the programmed control system, responsive to said detection of said type of drilling head and said operating parameter values, during said drilling operation of said borehole in said area of interest, determines a given soil class present in the portion of the earth borehole being drilled, based on the drilling head type used, and said selected operating parameters, in association with a database of soil classifications which associates soil classes with drilling head type, and said operating parameters; and wherein the programmed control system is further adapted to receive location points of the drilling head during said drilling operation, and correlate said received location points of the drilling head with the determined soil class, to thereby map the determined one or more soil classes over the select area of interest;

wherein the programmed control system exerts influence on the horizontal ground drilling device's machine control to optimize the process of creating the horizontal earth borehole.

6. The horizontal ground drilling device of claim 5, wherein said programmed control system is further responsive to one or more commands indicative of a change to one or more of the type of drilling head being used or said at least one set operating parameter, for updating said determination of soil class present in the portion of the earth borehole being drilled, based on the one or more updated type of drilling head and at least one set operating parameter.

7. The horizontal ground drilling device of claim 5, further comprising a sensor arranged on the drilling head, the sensor configured to sense the pressure in the earth borehole, wherein the signal of the sensor is further used to determine the soil class.

8. The device according to claim 5, wherein the programmed control system uses fuzzy logic to determine the soil class from the operating parameters of the horizontal ground drilling device and the selected drilling head.

* * * * *